United States Patent [19]

Wetzels et al.

[11] 4,441,280

[45] Apr. 10, 1984

[54] DEVICE FOR CENTERLESS GRINDING OF ROTATION-SYMMETRICAL SURFACES ON WORK PIECES

[75] Inventors: Walter Wetzels, Aachen, Fed. Rep. of Germany; Kurt Crott, Eupen, Belgium; Erich Voell, Roetgen, Fed. Rep. of Germany

[73] Assignee: Schumag GmbH, Aachen, Fed. Rep. of Germany

[21] Appl. No.: 214,760

[22] Filed: Dec. 9, 1980

[30] Foreign Application Priority Data

Dec. 10, 1979 [DE] Fed. Rep. of Germany ..... 2949538

[51] Int. Cl.[3] ..... B24B 41/00

[52] U.S. Cl. ..... 51/103 R; 51/166 R; 51/166 MH

[58] Field of Search ..... 51/103 R, 103 TF, 236, 51/166 R, 166 MH

[56] References Cited

U.S. PATENT DOCUMENTS

| | | | |
|---|---|---|---|
| 577,907 | 3/1897 | Wootton | 51/103 TF |
| 587,395 | 8/1897 | Illingworth | 51/103 TF |
| 963,610 | 7/1910 | Matheus | 51/103 R |
| 2,073,079 | 3/1937 | Theler | 51/103 TF |
| 3,209,498 | 10/1965 | Pall | 51/103 TF |
| 3,967,515 | 7/1976 | Nachtigal | 51/103 R |
| 4,063,906 | 12/1977 | Wetzels | 51/103 TF |

*Primary Examiner*—Harold D. Whitehead

*Attorney, Agent, or Firm*—Herbert L. Lerner; Laurence A. Greenberg

[57] ABSTRACT

Device for centerless grinding of rotation-symmetrical surfaces on workpieces at a grinding station, including drive means for turning a workpiece about the axes of symmetry thereof during grinding, a support bar for supporting the workpiece during turning, a rotatable disc being perpendicular to and disposed on each side of the workpiece generating vibrations of operating frequencies at the grinding station during grinding, at least one of the discs being a grinding wheel operating under grinding pressure, mechanical bearing supports and feed means for the discs forming an oscillating system with the discs generating resonance frequencies, and rigid connecting means for forming a rigid linkage of forces between the bearing supports and for increasing the resonance frequencies of the oscillating system beyond the operating frequencies.

13 Claims, 8 Drawing Figures

DEVICE FOR CENTERLESS GRINDING OF ROTATION-SYMMETRICAL SURFACES ON WORK PIECES

BACKGROUND OF THE INVENTION

1. Field of the Invention

The invention relates to a device for the centerless grinding of rotation-symmetrical surfaces on work pieces, including a drive to turn the workpieces about their axes of symmetry while they are being ground and while they are supported on a support bar; two rotating discs disposed on both sides of, and crosswise to, the work piece, at least one of which being a grinding disc working under grinding pressure; and mechanical bearing supports and feed means for the discs. The discs can be two grinding discs. However, one grinding disc and one control disc may also be provided. The workpieces may be elongated cylindrical workpieces which are not only turned during the grinding but also advanced in the longitudinal direction. They may also be shorter work pieces which can also have sections of different diameter. Also included is a feature of cutting-off by means of cutting-off discs.

2. Description of the Prior Art

In all these operations, vibrations of operating frequencies are generated at the grinding station. On the other hand, the mechanical bearing supports and feed means for the disc together form an oscillating system. It frequently happens that this oscillating system is excited to resonance vibrations by the operating frequencies, whereby vibrations with so high an amplitude can occur that undesirable markings are formed on the surface of the work pieces. In order to avoid this, the bearing supports for the discs have already been equipped with large masses. This was based on the concept that the vibration would be reduced with a larger mass. The support for the bearings was then often constructed in the form of heavy swinging arms or heavy carriages on a sliding track. It has been found that the vibrations of the bearing supports and the undesired markings caused by these vibrations are not reliably eliminated thereby. It was determined by tests that the reason for this is that the hereinafore-mentioned heavy supports cause resonance frequencies for the vibrations of the disc bearings which are approximately at 60 to 80 Hz. These are frequencies which can be generated by the grinding and which then make the entire machine vibrate. If the masses serving to mount the disc bearings are increased further, the spring constant of the oscillating system given by the elasticity of the machine frame is generally also increased due to the mechanical construction, so that the reasonance frequencies with their detrimental accompanying phenomena remain substantially unchanged.

SUMMARY OF THE INVENTION

It is accordingly an object of the invention to provide a device for centerless grinding of rotation-symmetrical surfaces on workpieces, which overcomes the hereinafore-mentioned disadvantages of the heretofore-known devices of this general type, and to construct the bearing supports for the discs in such a manner that the machine vibration and undesirable markings on the workpieces that have been described are avoided.

With the foregoing and other objects in view there is provided, in accordance with the invention, a device for centerless grinding of rotation-symmetrical surfaces on workpieces at a grinding station, comprising drive means for turning a workpiece about the axes of symmetry thereof during grinding, a support bar for supporting the workpiece during turning, a rotatable disc being perpendicular to and disposed on each side of the workpiece for generating vibrations of operating frequencies at the grinding station during grinding, at least one of the discs being a grinding wheel operating under grinding pressure, mechanical bearing supports and feed means for the discs forming an oscillating system with the discs generating resonance frequencies, and rigid connecting means for forming a rigid linkage of forces between the bearing supports and for increasing the resonance frequencies of the oscillating system beyond the operating frequencies.

The rigid connecting piece gives the oscillating system a large spring constant. The rigid connecting piece itself can have a relatively small mass. Thus, a resonance frequency is obtained for the oscillating system which is appreciably higher than the operating frequency generated at the grinding station. This achieves the result that resonances can no longer be fanned or stepped up.

In accordance with another feature of the invention, the rigid connecting means are in the form of two side plates, the bearing supports being held in the side plates and the discs being between the side plates. In this manner, a very rigid force linkage between the bearing supports is obtained. In addition, the following advantage is provided: The force is transmitted largely without transmitting bending moments. This results in the desired rigidity with a relatively small cross section of the connecting piece. This has an effect not only on reducing costs, but also with respect to a high resonance frequency, which depends, on the one hand, on a large spring constant, and on the other hand, on a small mass.

In accordance with a further feature of the invention, the side plates have cutouts formed therein for the passage of elongated workpieces. In addition, the supports for the bearings may be adjustable to allow the feed in accordance with the grinding.

In accordance with an added feature of the invention, the bearing supports include sliders and a slideway for the sliders.

In accordance with an additional feature of the invention, the slideway is a frame having long and short sides, the sliders being slideably guided between the long sides of the slideway.

In accordance with yet another feature of the invention, the connecting means are in the form of at least one rigid rod connected to the sliders, or between the sliders.

This embodiment has the advantage that on the one hand, the connecting piece again has to transmit no, or at most very small, bending moments and that the bearing supports have only a very small mass. It has been determined by tests that in this embodiment the resonance frequencies of the vibrating system can be at about 1000 Hz. Such a high frequency is by far not generated as the operating frequency at the grinding station, so that resonances can no longer be fanned up. It was further determined by tests that the rigidity or stiffness of the machine is about 100 times higher in the direction of the disc bearing than in the known bearing system with the heavy swinging arms or heavy carriages. The reason for less stiffness in the known bearing systems is in particular that the spring constant of the oscillating system is given by a relatively long path of the force through the machine frame, slider etc. with transmission of bending moments. The invention on the other hand is based, among other things, on the discovery that a direct rigid connection of the bearing supports constructed as sliders is the best construction for achieving great stiffness and low mass. At the same time, this construction is also more cost-effective than that of the hereinafore-mentioned heavy and expensive swinging arms or carriages. The light-weight construction also provides the following advantage: For large weights, the feeding of the grinding discs in small amounts is not possible because of the so-called stick-slip effect. Because of the light-weight construction of the machine according to the invention, this effect does not take place and feeding of the grinding discs can be effected in very small amounts (down to 0.0001 mm).

If the above-mentioned frame for guiding the sliders is used, then in accordance with yet a further feature of the invention, the connecting means are in the form of rigid abutments disposed between the sliders and the short sides or ends of the frame. This embodiment has the advantage that the theoretical connecting line of the disc bearings can coincide with the center line of the connecting piece, so that completely symmetrical relationships can be provided in a simple manner. Including the frame in the force transmission system results in a somewhat smaller or lower spring constant. It has been found, however that this spring constant is still sufficiently large to achieve the desired height of the resonance frequencies of the oscillating system.

Whether the connecting piece is constructed as a rigid rod between the sliders or the sliders are constructed as rigid abutments against the ends of the frame, in accordance with yet an added feature of the invention, the connecting means are adjustable in order to make a setting of the sliders according to the grinding operation possible.

In accordance with yet an additional feature of the invention, the connecting means include at least one screw spindle for setting the sliders.

In accordance with again another feature of the invention, the at least one screw spindle is in the form of at least two screw spindles being symmetrically disposed with respect to the sliders.

In accordance with again a further feature of the invention, the sliders include means for producing vibration damping dosed friction or the sliders are constructed with vibration damping, dosed friction. This vibration-damping may in some cases be more advantageous than a gliding connection of the sliders to the frame, if possible without forces.

In accordance with again an added feature of the invention, the connecting piece and support bar are firmly connected to each other. This increases the rigidity or stiffness without increasing the weight.

In case an already-existing machine with a bearing support on swinging arms or a bearing support at sliders on slideways is to be improved while retaining the existing parts as far as possible, in accordance with again an additional feature of the invention, there are provided swinging arms supporting the discs and having free ends, and a screw-spindle connecting the free ends to each other.

Similarly, in accordance with a concomitant feature of the invention, there are provided supports for the sliders, a slideway for the sliders, and screw spindles connecting the supports to each other.

BRIEF DESCRIPTION OF THE DRAWING

Other features which are considered as characteristic for the invention are set forth in the appended claims.

Although the invention is illustrated and described herein as embodied in a device for centerless grinding of rotation-symmetrical surfaces on work pieces, it is nevertheless not intended to be limited to the details shown, since various modifications and structural changes may be made therein without departing from the spirit of the invention and within the scope and range of equivalents of the claims.

Figure 1:
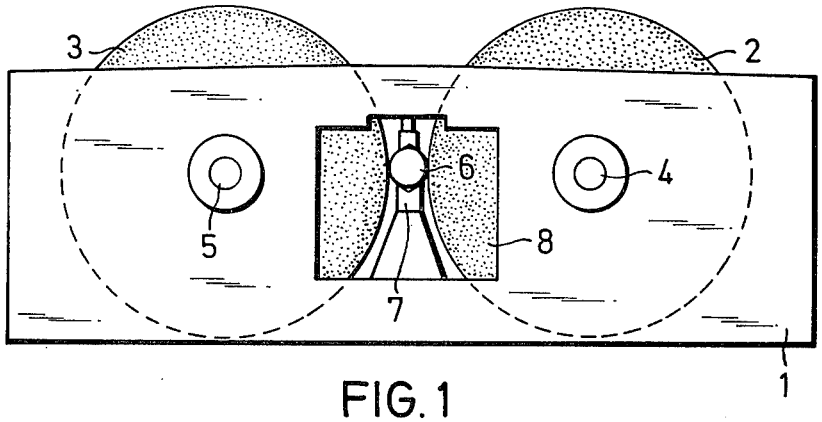
Figure 2:
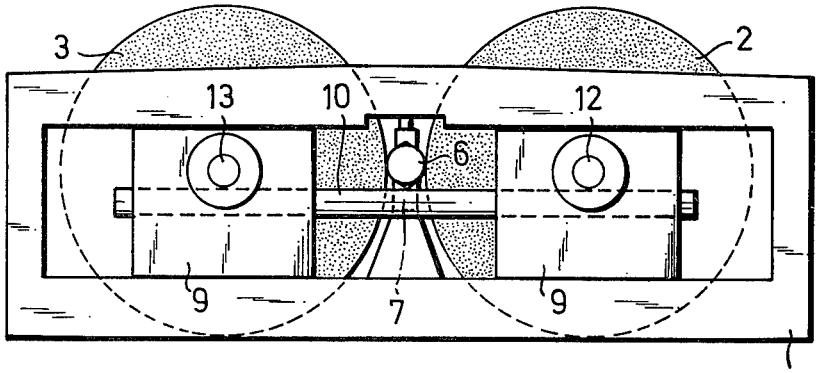
Figure 3:
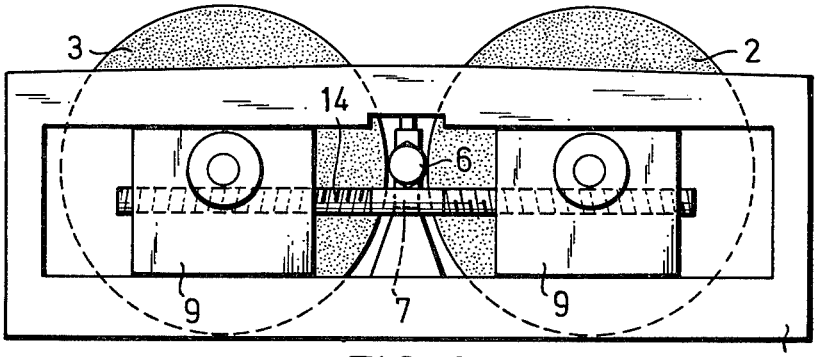
Figure 4:
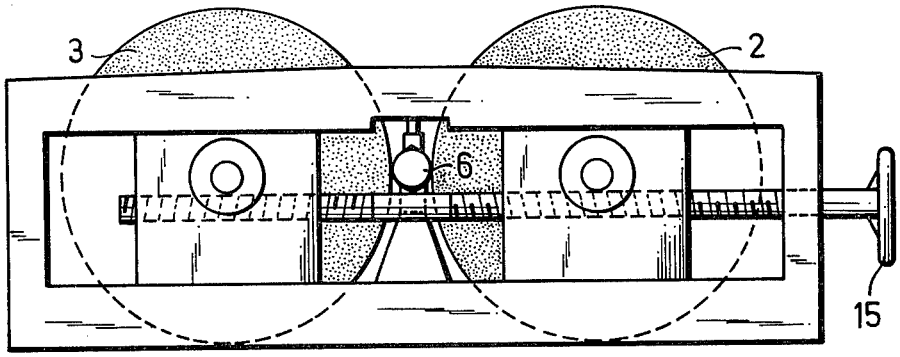
Figure 5:
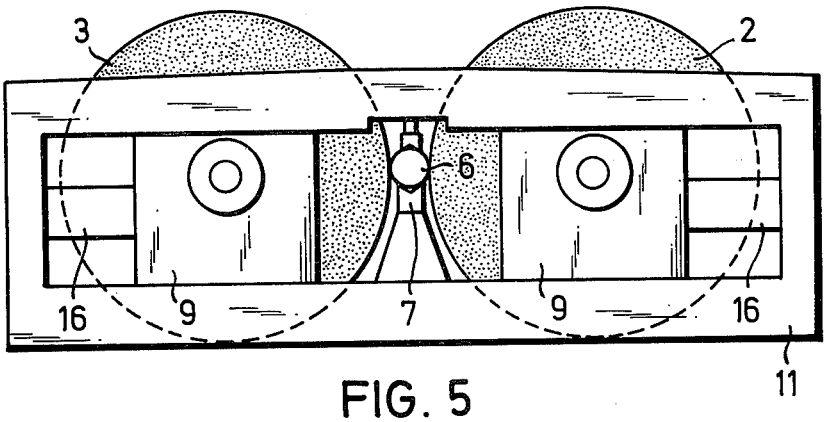
Figure 6:
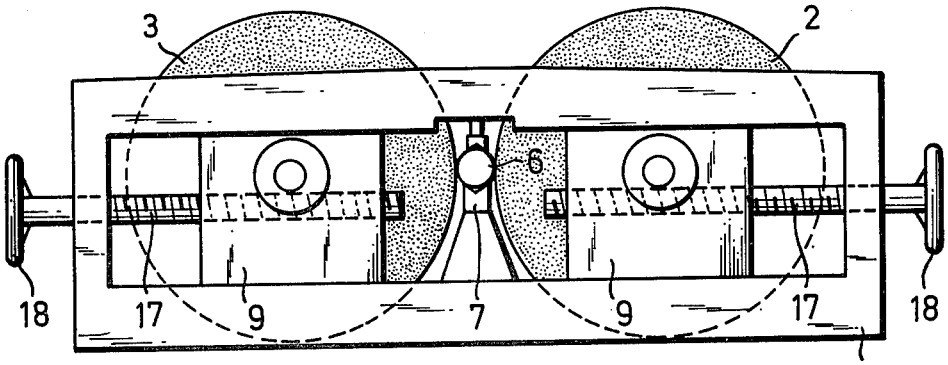
Figure 7:
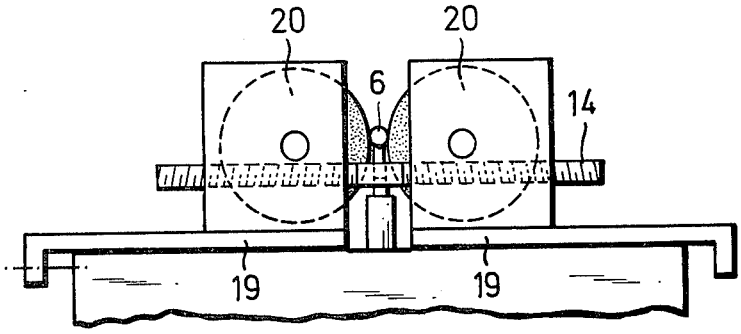

The construction and method of operation of the invention, however, together with additional objects and advantages thereof will be best understood from the following description of specific embodiments when read in connection with the accompanying drawings, in which:

FIG. 1 is a diagrammatic front elevational view of an embodiment of the device according to the invention with a construction of the connecting piece that includes two side plates, between which the discs are disposed and at which the bearings for the discs are held, and with a cutout in the side plates which serves for passing elongated work pieces through;

FIG. 2 is a view similar to FIG. 1 of another embodiment with a construction of the bearing supports as sliders on a slideway which is in the form of a frame, between the long sides of which the sliders are guided in a sliding relationship, and in which the connecting piece is constructed as at least one rigid rod between the sliders;

FIG. 3 is a similar view of an embodiment according to FIG. 2 with a connecting piece construction in the form of at least one screw spindle through which the sliders can be set;

FIG. 4 is a similar view of an embodiment according to FIG. 3 with a handwheel for feeding:

FIG. 5 is a view which is similar to the other figures, of an embodiment in which the connecting pieces are constructed as rigid abutments of the sliders against the ends of the frame;

FIG. 6 is a similar view of an embodiment according to FIG. 5, in which the connecting piece, which forms the rigid abutments of the sliders against the ends of the frame, is constructed as settable screw spindles;

FIG. 7 is a fragmentary, diagrammatic front elevational view of an embodiment with two sliders on a slideway in which the supports for the disc bearings are connected together by screw spindles; and FIG. 8 is a view which is again similar to the other figures, of an embodiment with two swinging arms, the free ends of which are connected to each other by screw spindles.

DESCRIPTION OF THE PREFERRED EMBODIMENTS

Referring now to the figures of the drawing and first particularly to FIG. 1 thereof, there are seen two side plates 1, between which discs 2 and 3 are disposed. The bearings for the discs are supported at supports 4 and 5. The workpiece 6 is supported on the support bar 7. The cutout 8 in the side plates serves for allowing elongated workpieces to pass through. The discs 2 and 3 can both be grinding wheels. In that case, the workpiece 6 must be set in rotation separately, and optionally advanced in the process. This can be accomplished by non-illustrated drive and polishing discs which precede and/or follow the grinding wheels. In the alternative, one of the discs 2, 3 is a so-called control disc which takes care of the rotary drive of the workpiece 6. The oscillating system includes the side plates for feeding or holding the discs, the shaft bearings at 4 and 5 and the discs 2 and 3. Due to the rigidity or stiffness of the side plates, the spring constant of this oscillating system is very large and the resonance frequency of the oscillating system is accordingly high. At the same time, the mass of the side plates is relatively small (as compared to the known swinging arms), which likewise contributes to the fact that the resonance frequency is high. The operating frequencies generated at the grinding station (i.e., the point of contact between the workpiece 6 and the discs 2 and 3) are substantially lower than that, as was determined by tests. Resonances which would set the entire machine in vibration, are not fanned or stepped up.

According to FIG. 2, the bearing supports 12, 13 for the discs 2 and 3 are constructed with sliders 9 on a slideway or track which forms a frame 11 as feed means. The sliders 9 are guided between the long sides of the frame 11 in a sliding relationship. The rigid connecting piece is in the form of at least one rigid rod 10 between the sliders 9 which are the bearing supports. Since the sliders 9 can have an even substantially smaller mass than the side plates 1 according to FIG. 1, a still higher resonance frequency of the oscillating system can be obtained with the embodiment according to FIG. 2. Up to 1000 Hz are generated while the operating frequencies generated at the point of grinding are only at about 60 to 80 Hz. It is advisable to symmetrically provide two or more rods 10 on both sides of the discs 2 and 3 so that the rigid rod 10 is not stressed by bending moments, which would cause the spring constant of the oscillating system to be decreased. Together the rods 10 form the rigid connecting piece. The sliders 9 and the frame 11 can also be made in duplicate on both sides of the discs 2 and 3.

FIG. 3 corresponds to FIG. 2 to a large extent. The connecting piece 14, however, is constructed as at least one screw spindle, through which the sliders 9 can be set.

FIG. 4 corresponds for the most part to FIG. 3, but a handwheel 15 is shown which serves for setting the connecting piece and sliders.

FIG. 5 shows an embodiment in which the connecting pieces are constructed as rigid abutments 16, bracing the sliders 9 against the end of the frame 11. The abutments 16 are advantageously provided in duplicate in an arrangement which is symmetrical to the discs, and likewise to the frame 11 and the sliders 9. The spring constant of the oscillating system is somewhat smaller than in the embodiment according to FIG. 2 because the frame is included in the path of the force. However, this embodiment provides the advantage that the space between the discs 2, 3 is completely free for the support bar 7 and the workpiece 6.

FIG. 6 shows an embodiment which begins with the device according to FIG. 5, but in which the connecting piece, which forms the rigid abutment of the sliders 9 against the ends of the frame 11, is constructed as settable screw spindles 17. The hand wheels 18 serve for setting the spindles 17.

Figure 8:
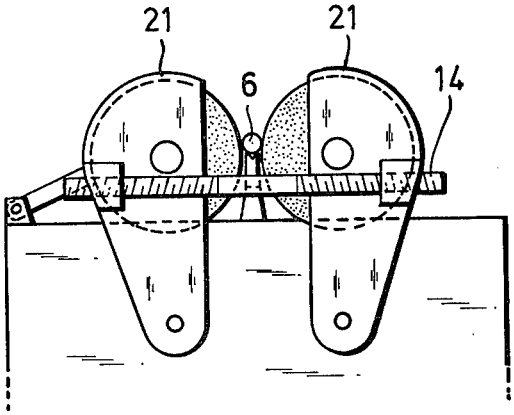

FIGS. 7 and 8 show known embodiments with discs 20 and sliders on a slideway 19 in FIG. 7, and swinging arms 21 in FIG. 8, which have been improved by the rigid connecting piece 14 according to the invention.

A comparison of an embodiment example constructed according to the invention, and to the prior art, gives the following results:

Measured static stiffness between the disc bearings and a known grinding and polishing machine with swinging arms:

0.035 μm/N: Resonance frequency: 75 Hz

Calculated stiffness of the machine according to the invention as per FIGS. 2 or 3:

0.0006 μm/N: Resonance frequency approximately: 1000 Hz.

There are claimed:

1. Device for centerless grinding of rotation-symmetrical surfaces on workpieces at a grinding station, comprising drive means for turning a workpiece about the axes of symmetry thereof during grinding, a support bar for supporting the workpiece during turning, a rotatable disc being perpendicular to and disposed on each side of the workpiece generating vibrations of operating frequencies at the grinding station during grinding, at least one of said discs being a grinding wheel operating under grinding pressure, mechanical bearing supports and feed means for said discs forming an oscillating system with said discs generating resonance frequencies, and rigid connecting means for forming a direct rigid linkage of forces between said bearing supports and for increasing the resonance frequencies of said oscillating system to the range of approximately 1000 Hz, said range being beyond said operating frequencies, said rigid connecting means being in the form of two side plates, said bearing supports being held in said side plates and said discs being disposed between said side plates.

2. Device according to claim 1, wherein said side plates have cutouts formed therein for the passage of elongated workpieces.

3. Device according to claim 1, wherein said connecting piece and support bar are firmly connected to each other.

4. Device for centerless grinding of rotation-symmetrical surfaces on workpieces at a grinding station, comprising drive means for turning a workpiece about the axes of symmetry thereof during grinding, a support bar for supporting the workpiece during turning, a rotatable disc being perpendicular to and diposed on each side of the workpiece generating vibrations of operating frequencies at the grinding station during grinding, at least one of said discs being a grinding wheel operating under grinding pressure, mechanical bearing supports and feed means for said discs forming an oscillating system with said discs generating resonance frequencies, and rigid connecting means for forming a direct rigid linkage of forces between said bearing supports and for increasing the resonance frequencies of said oscillating system to the range of approximately 1000 Hz, said range being beyond said operating frequencies, said connecting means being in the form of at least one rigid rod.

5. Device according to claim 4, wherein said bearing supports include sliders directly connected to said rigid rod and a slideaway for said sliders.

6. Device according to claim 5, wherein said slideway is a frame having long and short sides, said sliders being slideably guided between said long sides of said slideway.

7. Device according to claim 6, wherein said connecting means are in the form of rigid abutments disposed between said sliders and said short sides of said frame.

8. Device according to claim 6, 4 or 7, wherein said connecting means are adjustable.

9. Device according to claim 8, wherein said connecting means consists of one screw spindle for setting said sliders.

10. Device according to claim 9, wherein said at least one screw spindle is in the form of at least two screw spindles being symmetrically disposed with respect to said sliders.

11. Device according to claim 5, wherein said sliders include means for producing vibration damping dosed friction.

12. Device according to claim 4, including swinging arms supporting said discs and having free ends, and a one-piece screw spindle directly connecting said free ends to each other.

13. Device according to claim 4, including sliders, supports mounted on said sliders, a slideway for said sliders, and said rigid rod being screw spindles directly connecting said supports to each other.

* * * * *